United States Patent [19]

Townsend, Jr.

[11] Patent Number: 4,951,662

[45] Date of Patent: Aug. 28, 1990

[54] AIR CIRCULATING SURGICAL MASK UNIT

[76] Inventor: Andrew L. Townsend, Jr., 900 Wildwood, East Lansing, Mich. 48823

[21] Appl. No.: 349,167

[22] Filed: May 8, 1989

[51] Int. Cl.[5] ..... A62B 18/02

[52] U.S. Cl. ..... 128/205.25; 128/201.15; 128/206.21; 128/207.12

[58] Field of Search ..... 128/201.15, 206.19, 128/206.28, 863, 204.17, 201.25, 204.15, 204.18, 205.25, 206.21, 207.12

[56] References Cited

U.S. PATENT DOCUMENTS

| | | | |
|---|---|---|---|
| 3,058,463 | 10/1962 | Goodrich, Jr. | 128/863 |
| 3,625,207 | 12/1971 | Agnew | 128/206.28 |
| 3,747,599 | 7/1973 | Malmin | 128/863 |
| 4,121,571 | 10/1978 | Pickering | 128/204.17 |
| 4,296,746 | 10/1981 | Mason, Jr. et al. | 128/201.15 |
| 4,469,097 | 9/1984 | Kelman | 128/206.19 |

*Primary Examiner*—Edgar S. Burr
*Assistant Examiner*—Aaron J. Lewis
*Attorney, Agent, or Firm*—Beaman & Beaman

[57] ABSTRACT

A surgical mask unit characterized by its comfort and ability to eliminate eyeglass fogging by utilizing a housing adjacent the surgical mask having a volume considerably larger than the mask volume permitting the breath to be substantially removed from the mask during each breathing cycle. Preferably, the housing is in the form of a loop encircling the wearer's neck, and a circulating fan may be located in the housing to augment the advantages and draw fresh air into the housing through a controlled inlet.

1 Claim, 2 Drawing Sheets

AIR CIRCULATING SURGICAL MASK UNIT

BACKGROUND OF THE INVENTION

The present invention relates to the field of surgical face masks, more specifically, it relates to making the surgical mask more comfortable to wear over extended periods of time.

In an effort to maintain aseptic conditions during treatment, health care professionals have accepted the use of surgical face masks as standard procedure. Although accepted as standard procedure, wearing a surgical mask creates two main problems for the user. First, the air space between the users face and the mask's inner surface is very limited. This limited air space volume does not allow the exhaled air to flow from the space quickly enough, and the trapped air becomes warm, making it difficult to breathe and uncomfortable to wear. Second, air trapped within the mask tends to escape upward at the top edge of the mask. If eye glasses are worn, this escaping warm moist air can cause eye glass fogging, which can interfere with the user's ability to perform treatment.

In an effort to eliminate these problems several solutions have been suggested. C. D. Kelman in U.S. Pat. No. 4,469,097 provides a mask attached to a container of pressurized gas which periodically releases oxygen through a valve to the surgical mask to enhance the user's ability to breathe. This pressurized container would be inconvenient to continually refill or replace and would be an added expense to the use of this apparatus. Kelman's apparatus only supplies oxygen in intermittent bursts, which would be inadequate to maintain a cool comfortable mask. Also, Kelman's apparatus does not actively remove air from the mask. The outlet tubing 18 opens to the atmospheric air and allows for only passive air flow. With this in mind, as oxygen is forced from the pressurized cylinder to the mask, increased pressure in the mask could allow warm air to leak and cause eye glass fogging. Warm exhaled air would still tend to accumulate, making the mask uncomfortable.

It is an object of the present invention to effectively remove warm moist air from the surgical mask to allow for greater user comfort and the elimination of eyeglass fogging. The present invention creates both positive and negative air pressures, produced from a single air circulating fan, which actively circulates air through the mask and complete unit. This continuous flow of air through the mask does not allow warm moist air to leak and fog eyeglasses, and effectively removes the warm exhaled air away from the mask, making the mask very comfortable.

B. F. Agnew in U.S. Pat. No. 3,625,207 discloses a suction ducting system for use under a surgical mask. The primary objective as stated is to remove potentially harmful exhaled air away from the mask to be disposed of at a distant site. This ducting system must be attached to a vacuum source away from the user's body, therefore limiting the user's mobility. It is also my experience with a vacuum ducting system that the vacuum creates a very loud and annoying sound.

An objective of the present invention is to allow the user complete mobility. The air circulating surgical mask unit is lightweight, compact, and completely self-contained on the user's body. It also has a very low noise level while in operation.

C. A. Dempsey ET AL. U.S. Pat. No. 3,130,722 discloses a respiratory mask with outlet tubing attached to a source of negative pressure to pull exhaled air away from the mask for disposal at a more distant site. The mask disclosed by C. A. Dempsey ET AL. is unconventional and would be more expensive to produce than modifying existing commercial forms, and may not be readily accepted by the health care profession. Due to the limited volume of air within the unit a small electric exhaust fan would be ineffective at creating and maintaining adequate negative pressure to keep the mask from becoming warm and uncomfortable. The exhaust fan would be choked off due to the small volume of air available to draw upon. The air is pulled away from the mask with no circulation of air back to replenish the column of air lost.

It is an objective of the present invention to eliminate these problems as follows: (1) The air circulating surgical mask unit can utilize conventional face masks modified only by the placement of two holes which allow for the attachment of the unit to the mask. Standard masks could be modified using a template punch mechanism to cut the necessary two holes, or masks could be manufactured with the holes in place at little extra expense. (2) The functional design of the present invention is such that it cannot be choked off by a lack of available air. The unit is basically a loop or circular tube filled with air. A single air circulating fan is positioned within this circular loop and while in operation creates positive pressure on one side of the fan and negative pressure on the other side. Utilizing both the positive and negative air pressure created by the air circulating fan makes the unit's design unique and highly efficient. The air within the unit is pushed from the fan toward the mask and pulled from the mask toward the fan. The air within the unit circulates or flows in a circular fashion creating a continuous column of air to maintain adequate air flow.

The present invention also utilizes an air-mixer-filter component in cooperation with the air circulating fan, which allows for a controlled variable amount of filtered atmospheric air to enter into the unit.

SUMMARY OF THE INVENTION

The present invention was conceived with the objective to provide a surgical mask which has all the features of available surgical masks of commerce and in addition would have increased user comfort. Since the discomfort of a surgical mask is due to the trapping of warm moist exhaled air, which can also leak upward to fog eyeglasses, the air circulating surgical mask unit was designed to create air flow or air circulation to avoid exhaled air becoming trapped within the mask. The advantages of the present invention are as follows:

(1) The unit greatly increases user comfort due to the cooling effect of the circulating air.

(2) Eyeglass fogging is eliminated as exhaled air is pulled away from the mask.

(3) The unit is compact, lightweight, and completely self-contained with no restriction on user mobility.

(4) Conventional masks can be modified easily for use with the unit.

(5) The invention's efficient design utilizes both the positive and negative air pressure created by a single air circulating fan to develop and maintain adequate air flow. The circular flow of air does not allow for diminished air volume to choke off the air circulating fan.

(6) Utilizing the air mixer filter component, the user can control the amount of intermixing of air between the atmospheric air and the air within the unit.

(7) The unit has a low noise level while in operation.

(8) The unit's design is very simple and should be relatively inexpensive to manufacture, produce, and make available to the health profession and others utilizing surgical face masks.

DETAILED DESCRIPTION

Figure 1:
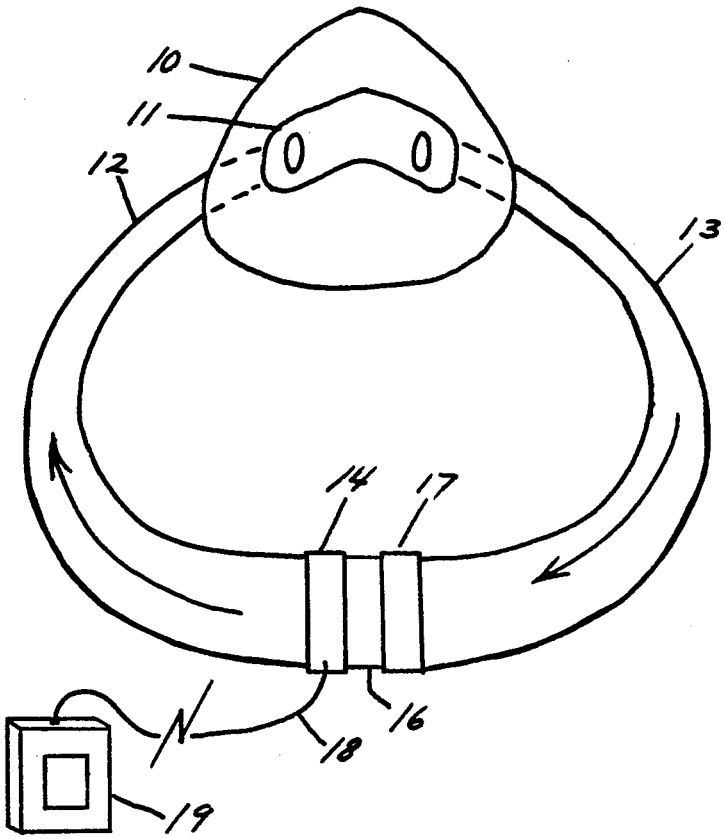
FIG. 1 is a somewhat diagrammatic rear view of the present invention.
Figure 2:
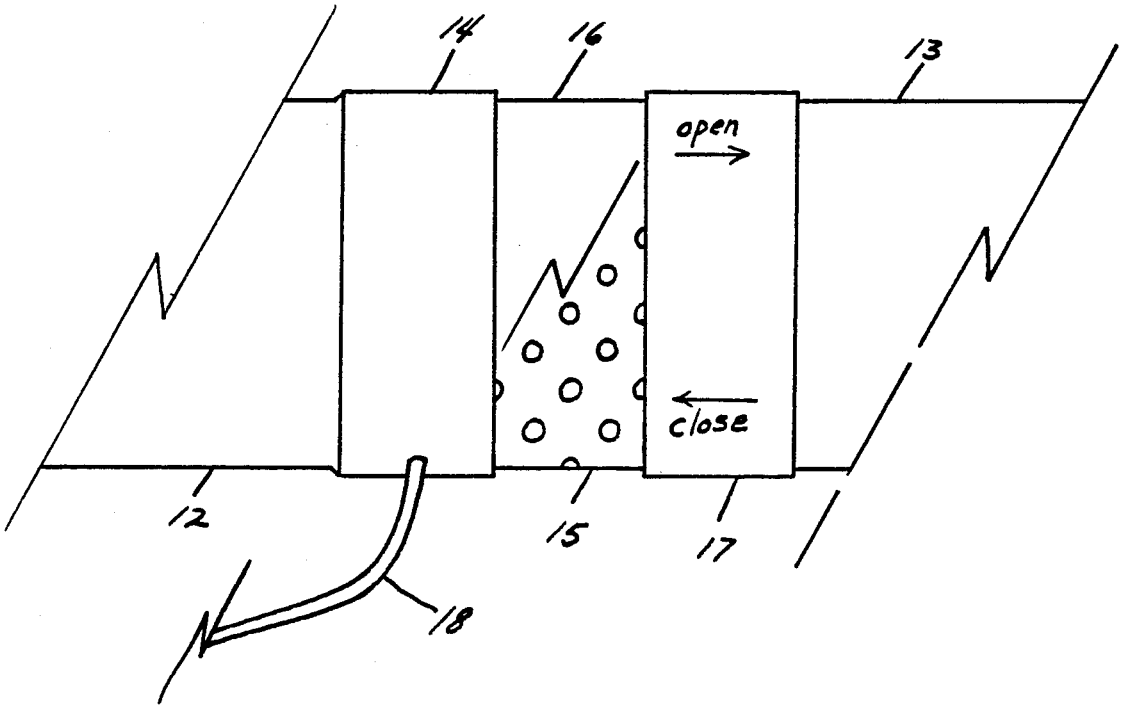
FIG. 2 is a detailed view showing the arrangement of the air mixer filter component to the air circulating fan.
Figure 3:
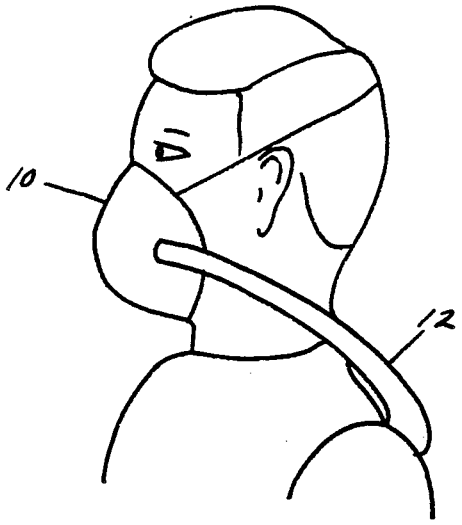
FIGS. 3, 4, and 5 illustrate the present invention in use from side, front and rear views.
Figure 4:
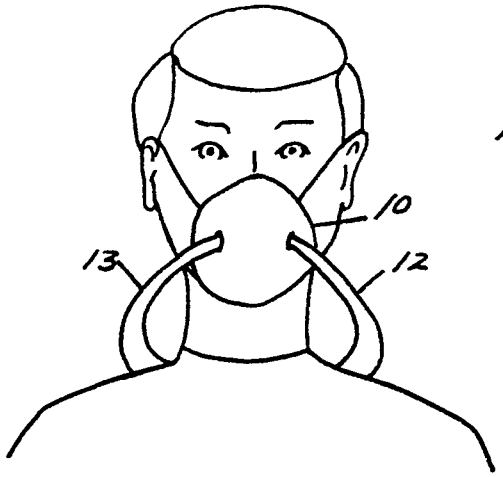
Figure 5:
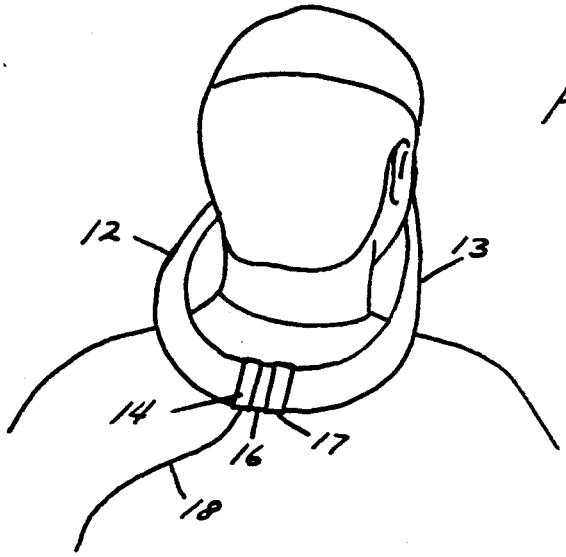

Referring now to the drawings, there is illustrated a surgical mask 10. According to the present invention this mask could be either a non-disposable permanent mask or a disposable mask utilizing available standard conventional forms, modified only by the placement of two holes which would allow for the attachment of the mask to the unit. It is definitely an advantage that standard conventional masks with minor modification can be utilized with the present invention.

Tubular projections from the mask contour plate 11 are placed through the holes in the mask and attach to the reserve air chamber tubes 12 and 13. The mask contour plate helps to maintain the masks shape during function and secures the mask to the reserve air chamber tubes. The reserve air chamber tubes offer a pathway through which circulating air can flow to and from the mask. They also enlarge the air space volume within the unit to over eight times the normal air space volume of a standard surgical mask, which is limited to the space between the user's face and the inner surface of the mask. The increased air space volume decreases air resistance to circulation flow and allows more air within the unit for enhanced breathability. During operation the air circulating fan 14 creates air flow which circulates in a circular fashion, flowing from the fan through the positive reserve air chamber tube 12, to the surgical mask 10, past the mask contour plate 11, back out into the negative reserve air chamber tube 13 and back again to the air circulating fan.

This circulating of the air creates a cooling and drying effect on the exhaled air, making the mask more comfortable. The present invention is efficient and unique in that it utilizes both the positive and negative air pressure created from a single air circulating fan to maintain a circulating air flow through the unit.

If limited air interchange with the outside atmospheric air is desired, this can be accomplished through the air-mixer-filter component in cooperation with the air circulating fan. The air-mixer-filter component is composed of: an air exchange tube 15, which is basically a tube with holes to allow for the passage of air in or out; an air filter 16, which limits particle size passing through the air exchange tube; and an air-mixer sleeve 17, which slides over the air exchange tube and filter to adjust the amount of air mixing or interchange. When the air-mixer sleeve is in the fully open position, this allows for maximum intermixing of unit and atmospheric air and enhances the overall cooling capability of the unit. When the air-mixer sleeve is in the closed position minimal air mixing occurs. The rate of air flow through the air-mixer-filter component is completely adjustable. This unique component allows the user to regulate the amount of intermixing of unit air and atmospheric air.

The drawings also show the air circulating fan wiring 18 leading to the power supply casing 19, which contains the on/off switch control and will hold a rechargeable battery or battery pack unit to supply power to the air circulating fan. This power supply casing will be worn much like a pager or beeper. It may be possible to position the rechargeable battery in close proximity to the air circulating fan and eliminate the need for this type of power supply casing. Even so, the entire unit is very lightweight and compact, and allows for complete mobility since the unit is self-contained.

From the foregoing description it will be readily apparent that the air circulating surgical mask unit provides a simple, economical, efficient, non-restrictive, and unique arrangement for enhancing user comfort while wearing a surgical mask. Various modifications and changes may be made with regard to the foregoing description without departing from the true spirit of the invention or the scope of the following claims which I wish to secure by Letters Patent.

I claim:

1. A surgical mask unit comprising, in combination, a mask adapted to be placed over the wearer's mouth and nose defining a cavity of given volume, a port defined in said mask in communication with said cavity, and a lightweight housing located adjacent said mask in communication with said port, said housing defining a chamber having a volume several times that of said cavity given volume whereby the wearer's breath expands into said chamber during each breathing cycle, said housing being in the form of a loop for encircling the wearer's neck, first and second ports defined in said mask, said housing loop having first and second ends disposed adjacent said mask, said first port communicating with said housing first end and said second port communicating with said housing second end, and an electric circulating fan located within said housing for circulating air within said chamber loop and mask, said fan having a pressurized side and an exhaust side, said pressurized side being in communication with said first port and said exhaust side being in communication with said second port, a fresh air inlet port defined in said housing on said fan exhaust side for drawing fresh air into said housing, and a valve defined on said housing controlling the size of said inlet port to regulate the amount of fresh air drawn into said housing.

* * * * *